US009596949B1

(12) United States Patent
Scampoli

(10) Patent No.: US 9,596,949 B1
(45) Date of Patent: Mar. 21, 2017

(54) NECKLACE SUPPORT

(71) Applicant: Anthony Scampoli, North Chesterfield, VA (US)

(72) Inventor: Anthony Scampoli, North Chesterfield, VA (US)

(73) Assignees: Anthony Scampoli, North Chesterfield, VA (US); Marilyn Scampoli, North Chesterfield, VA (US)

( * ) Notice: Subject to any disclaimer, the term of this patent is extended or adjusted under 35 U.S.C. 154(b) by 0 days.

(21) Appl. No.: 14/542,519

(22) Filed: Nov. 14, 2014

(51) Int. Cl.

| | |
|---|---|
| ***A47F 7/02*** | (2006.01) |
| ***A47G 29/00*** | (2006.01) |
| ***A47H 1/00*** | (2006.01) |
| ***A47K 13/00*** | (2006.01) |
| ***A47F 5/00*** | (2006.01) |
| ***F16L 3/02*** | (2006.01) |
| ***A47G 25/74*** | (2006.01) |
| ***A47G 25/06*** | (2006.01) |
| ***A47F 7/12*** | (2006.01) |
| ***A47H 1/14*** | (2006.01) |

(52) U.S. Cl.
CPC ..... *A47F 5/0006* (2013.01); *A47F 5/0087* (2013.01); *A47F 7/02* (2013.01); *A47F 7/12* (2013.01); *A47G 25/0664* (2013.01); *A47G 25/0685* (2013.01); *A47G 25/746* (2013.01); *A47H 1/14* (2013.01); *F16L 3/02* (2013.01)

(58) Field of Classification Search
CPC .... F16L 3/02; A47F 7/022; A47F 7/12; A47F 7/19; A47F 7/26; A47F 5/08; A47F 5/0081; A47F 5/0876; A47F 7/005; A47F 5/0084; A47G 25/74; A47G 25/0607; A47G 25/0664; A47G 25/0685; A47G 25/0692; A47G 25/746; A47G 25/743; D06F 57/12; A47B 61/003; A47H 1/00; A47H 1/10; A47H 1/102; A47H 1/14; A47H 1/122
USPC .. 211/85.2, 89.01, 123, 124, 105.1, 99, 100, 211/101, 85.3, 119.004, 119.009, 87.01; 248/251, 261; 206/6.1, 485, 566, 495
See application file for complete search history.

(56) References Cited

U.S. PATENT DOCUMENTS 2,615,579 A * 10/1952 Sampson ..... A47G 25/746 211/100
2,868,389 A * 1/1959 Friend ..... A47G 25/0692 211/123
2,908,471 A * 10/1959 McFerrell ..... A47B 96/027 108/29
3,380,594 A * 4/1968 MacCluney ..... A47G 25/746 211/85.3
3,622,011 A * 11/1971 Snow ..... A47F 5/0823 248/220.41

(Continued)

*Primary Examiner* — Jennifer E Novosad
(74) *Attorney, Agent, or Firm* — Thedford I. Hitaffer; Hitaffer & Hitaffer, PLLC

(57) ABSTRACT

A rack supports and displays loop-like articles, such as necklaces. The rack includes a bar having a series of circumferential grooves and a holder for supporting the bar from a vertical surface. In one implementation, the holder is at the center of the bar, and is rigidly connected to the bar. In another implementation, the holder is at one end of the bar, with a pivot support at the other end of the bar. The bar is permanently and pivotally fixed to the pivot support, and releasably received in the holder. In the latter implementation, the bar can be lifted or pivoted out of engagement with the holder so that a necklace can be removed from the bar.

12 Claims, 2 Drawing Sheets

(56) References Cited

U.S. PATENT DOCUMENTS

D229,878 S 1/1974 Saika
3,907,119 A 9/1975 Franz
D250,303 S 11/1978 Haber
D269,397 S 6/1983 Van Duyne
D270,220 S 8/1983 Cuminale
4,671,415 A 6/1987 Manhart
4,717,028 A * 1/1988 Gochanour ..... A47G 25/48 211/105.1
4,729,482 A * 3/1988 Nicholson ..... A47K 10/04 211/105.2
4,805,786 A * 2/1989 Miller ..... A47G 25/0692 211/105.1
4,971,210 A * 11/1990 Blumenkranz .... A47G 25/0692 211/105.1
5,176,304 A * 1/1993 Palmer ..... B60R 7/10 211/123
5,449,073 A 9/1995 DeBeverly
5,531,416 A * 7/1996 Remmers ..... A47B 61/003 211/105.1
D372,380 S 8/1996 Montalbo et al.
D398,789 S 9/1998 Warshawsky
5,833,081 A * 11/1998 Smith ..... B60R 7/10 211/204
D425,331 S 5/2000 Murray
6,213,437 B1 * 4/2001 Robbins ..... A47H 1/142 160/330
6,216,889 B1 * 4/2001 Chang ..... A47H 1/122 211/105.1
D441,592 S 5/2001 Lin
6,536,718 B2 3/2003 Benito-Navazo
7,143,902 B2 * 12/2006 Iversen ..... A47F 7/24 16/87.4 R
D547,584 S 7/2007 Little
D554,982 S 11/2007 Wenck
7,806,280 B1 * 10/2010 Perkins ..... A47G 25/0685 211/100
7,891,506 B2 2/2011 Kornowski
8,231,093 B2 * 7/2012 Tran ..... A47H 1/142 16/87.2
8,418,975 B1 * 4/2013 Burr ..... A47H 1/142 248/261
8,998,006 B2 * 4/2015 Taurins ..... A47G 25/74 211/119
9,078,499 B1 * 7/2015 Brabec ..... A45C 11/00
2003/0192840 A1 10/2003 Hoyle et al.
2007/0090244 A1 * 4/2007 Goldstein ..... A47H 1/022 248/252
2012/0223039 A1 * 9/2012 Malmstadt ..... A47H 1/02 211/123
2013/0082017 A1 * 4/2013 Tang ..... A47H 1/02 211/124

* cited by examiner

NECKLACE SUPPORT

BACKGROUND OF THE INVENTION

The present invention relates to supports, and more particularly, to a support having a rod bearing dividers for separating loop forming objects being stored from one another.

Looped objects such as necklaces, bracelets, and the like, must from time to time be retrieved from storage for use. In the case of jewelry, it is desirable to observe and select from stored articles of jewelry. Also, small articles such as necklaces and bracelets are difficult to grasp if bunched together, as may occur in storage. Apparatuses intended to address the above concerns would find utility.

SUMMARY OF THE INVENTION

The present disclosure addresses the above stated needs by providing a support adapted for separating looped objects such as necklaces and bracelets, permitting observation of the looped objects while the looped objects are stored, and separating the looped objects to permit ready grasp and removal of one of the looped objects from storage.

The present invention relates to a storage and display rack for necklaces, comprising a bar including a cylindrical central section having a diameter, a first series of circumferential grooves on one side of the cylindrical central section, and a second series of circumferential grooves on an opposed side of the cylindrical central section. A holder includes a mounting base including a flat base surface, and a grip configured to partially encircle the bar. The grip is ultimately connected to the flat base surface and includes an elastic member having a circular inner wall having an extent between one hundred eighty and two hundred seventy degrees of a circle defined by the circular inner wall. The circular inner wall has an opening to the interior of the circular inner wall, the opening having an extent between ninety and one hundred eighty degrees of a circle defined by the circular inner wall, an inner surface slightly smaller in diameter than the diameter of the cylindrical central section of the bar, and an axis located centrally within the inner surface. The axis is parallel to the inner surface and also parallel to the flat base surface. Therefore, the grip can be elastically spread open to receive and release the central section of the bar, and elastically closes over and retains the bar after insertion of the bar in the grip.

In an exemplary realization of the disclosure, there is disclosed a storage and display rack for necklaces, comprising a bar including a proximal end, a distal end, and a series of circumferential grooves between the proximal end and the distal end; a pivot support at the proximal end of the bar, the pivot support including an engagement element engaging the proximal end of the bar and enabling the bar to pivot thereabout; and a holder at the distal end of the bar. The bar and the holder generally have the characteristics of the bar and holder of the previously described realization. The pivot support enables the bar to be lifted or rotated out of its former position received in the holder. This enables one or more necklaces to be retrieved from the bar. The bar may then be returned to its prior position received by the holder.

Various advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
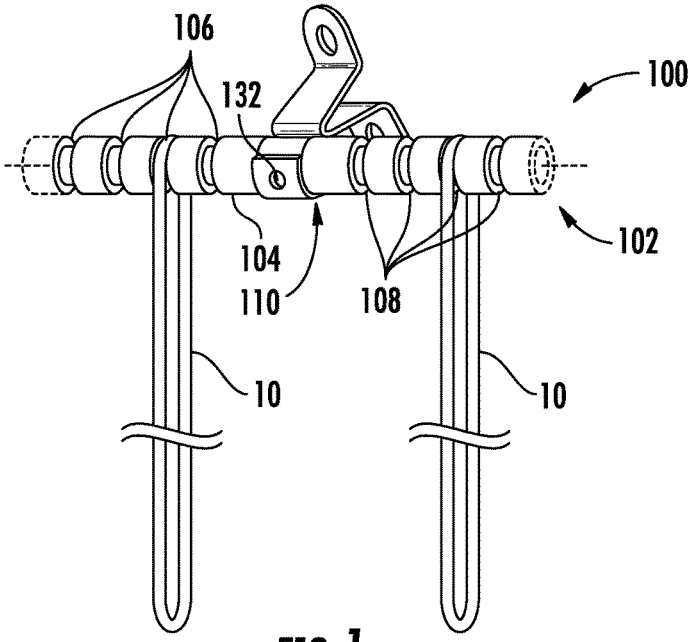
FIG. 1 is a perspective view of a storage and display rack for necklaces, according to one realization of the disclosure.
Figure 3:
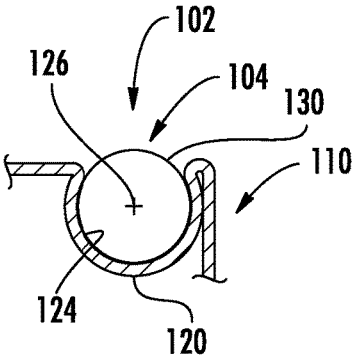
FIG. 3 is a fragmentary end detail view of the holder of FIG. 2, the holder shown engaging a bar seen at the top of FIG. 1.
Figure 2:
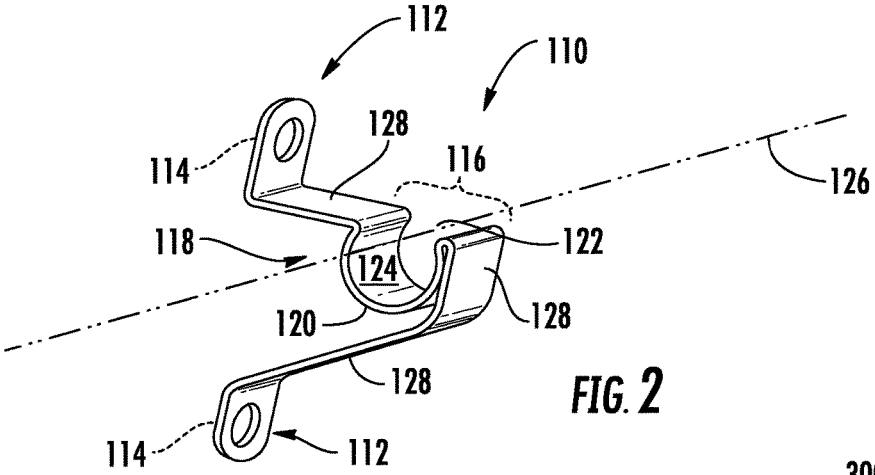
FIG. 2 is a perspective detail view of a holder shown at the upper center of FIG. 1.

To these and other ends, and referring to FIG. 1, in one exemplary realization, there is disclosed a storage and display rack 100 for necklaces 10, comprising a bar 102 including a cylindrical central section 104 having a diameter, a first series of circumferential grooves 106 on one side of the cylindrical central section 104, and a second series of circumferential grooves 108 on an opposed side of the cylindrical central section 104. Referring also to FIGS. 2 and 3, a holder 110 includes a mounting base 112 including a flat base surface 114, and a grip 116 configured to partially encircle the bar 102. The grip 116 is ultimately connected to the flat base surface 114 and includes an elastic member 118 having a circular inner wall 120 having an extent between about one hundred eighty-one and about two hundred seventy degrees of a circle defined by the circular inner wall 120. The circular inner wall 120 has an opening 122 to the interior of the circular inner wall 120, the opening 122 having an extent between about ninety and about one hundred eighty degrees of a circle defined by the circular inner wall 120, the inner surface 124 slightly smaller in diameter than the diameter of the cylindrical central section 104 of the bar 102, and an axis 126 located centrally within the inner surface 124. The axis 126 is parallel to the inner surface 124 and also parallel to the flat base surface 114. Therefore, the grip 116 can be elastically spread open to receive and release the central section 104 of the bar 102, and elastically closes over and retains the bar 102 after insertion of the bar 102 in the grip 116. Orientation of the axis 126 enables the grip 116 to hold the bar 102 parallel to a flat environmental surface, such as a building wall or partition (not shown) on which the holder 110 is mounted.

Spacing of the circumferential grooves 106, 108, or of the high portions of the bar 102, may be consistent, or alternatively, may be variable. Some circumferential grooves 106, 108 may be larger than others in depth or length or both, for example, to accommodate necklaces of different dimensions.

The grip 116 is ultimately connected to the flat base surface 114 in that there may be one or more intervening elements, such as straight sections 128.

The circular inner wall 120 does not form a complete circle. Rather, there is left open a portion enabling the bar 102 to be inserted into a receptacle provided by the grip 116. The circular inner wall 120 occupies just over half of the complete circle (e.g., about one hundred eighty-one to about two hundred seventy degrees of the complete circle), so that the bar 102 will be constrained against inadvertent dislodging from the grip 116. The complete circle alluded to above may be seen in FIG. 3 as the circumference 130 of the central section 104 of the bar 102. Therefore, it will be appreciated that "circular" as employed herein is intended as a descriptor indicating that the configuration of the inner surface 124 of the opening 122 corresponds to the circular outer surface of the central section 104 or of the bar 102, and is not to be construed as denoting full circular extent.

The magnitude of the theoretical full circle accounted for by the holder 110 is sufficient to retain the bar 102 within the grip 116 under ordinary conditions. Because the grip 116 is slightly elastic, it will deform to pass the bar 102 when the bar 120 is installed in and removed from the grip 116. The holder 110 may be made from steel sheet metal having slight spring characteristics, and may be a standard or off-the-shelf commercial product, such as a curtain rod holder. An exemplary rod holder is depicted in FIG. 2.

Reference to the inner surface 124 as being slightly smaller in diameter than the diameter of the cylindrical central section 104 of the bar 102 refers to deformation of the holder 110 when inserting or withdrawing the bar 102. Deformation occurs as the grip 116 spreads to accommodate the relatively greater diameter of the bar 102. This deformation disappears after full seating of the bar 102 within the grip 116, or after removal of the bar 116 from the grip 116. The slightly smaller diameter of the inner surface 124 prevails with the grip 116 in the undeformed state, in the absence of forces either spreading or compressing the circular inner wall 120.

Optionally, and as illustrated in FIG. 1, a diameter of the cylindrical central section 104 is equal to the diameter of the bar 102 between any two ones of first and second series of the circumferential grooves 106, 108.

Optionally, and also illustrated in FIG. 1, the storage and display rack 100 may include a fastener 132 coupling the bar 102 to the holder 110. The fastener 132 may be a pin, rivet, screw, or other fastener passing through the holder 110 and being anchored within the bar 102. The fastener 132 assures sturdiness of a connection between the bar 102 and the holder 110.

Optionally, it would be possible to support the bar 102 at both ends (this option is not shown), using two holders 110, rather than supporting the bar 102 at its center, as shown in FIG. 1.

Figure 4:
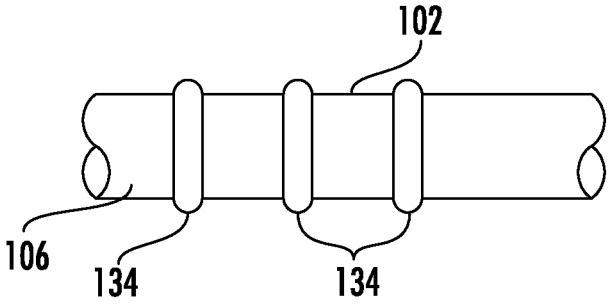
FIG. 4 is a fragmentary side detail view of an alternative to the holder of FIG. 2.

Referring now to FIG. 4, the storage and display rack 100 may include a plurality of O-rings 134 on the bar 102. Each one of the circumferential grooves 106 (or circumferential grooves 108) is defined between two adjacent ones of the plurality of O-rings 134. It would be possible to include some circumferential grooves 106 and/or 108 formed integrally within the bar 102, by cutting with a lathe for example, and some circumferential grooves 106 and/or 108 entirely or partially formed by the O-rings 134. An advantage of the O-rings 134 is that the O-rings 134 are movable along the bar 102, to vary width of the grooves 106, 108. Also, thicker 0-rings 134 may be utilized to increase depth of resultant the grooves 106, 108. The O-rings 134 may be of a variety of colors, for ornamentation or for coding of necklaces for different uses, for example.

Figure 5:
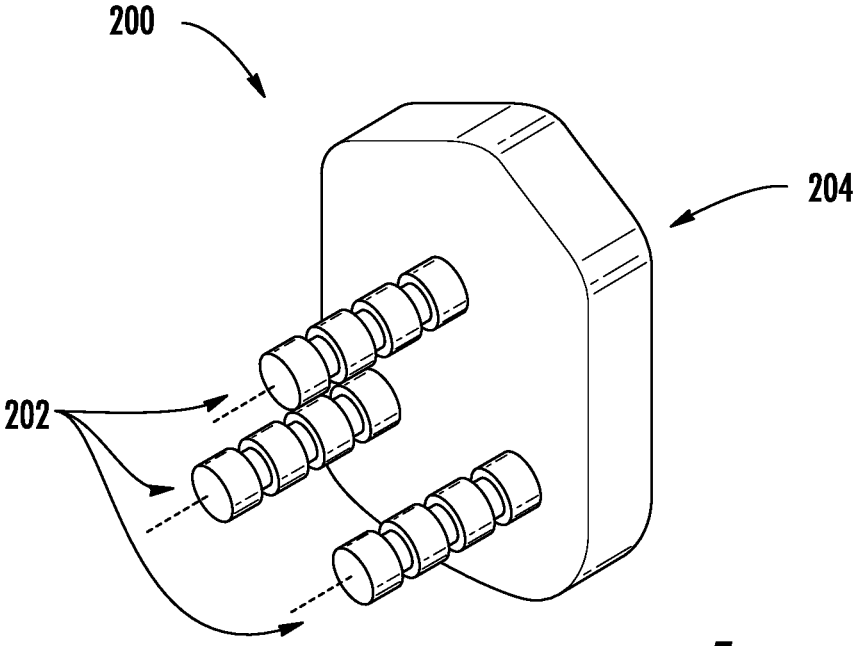
FIG. 5 is a perspective view of a storage and display rack according to at least one other aspect of the disclosure.

Turning now to FIG. 5, there is shown a storage and display rack 200 which includes a plurality of bars 202. The bars 202 may be similar in construction to the bars 102 of FIGS. 1-4. The bars 202 project from a wall mounting plate 204. The bars 202 may be secured to the wall mounting plate 204 by fasteners such as screws (not shown) passing through wall mounting plate 204. Alternatively, ends (concealed from view in FIG. 5) of the bars 202 may enter and at least partially occupy holes (not shown) in the wall mounting plate 204.

Arrangement of the bars 202 may be varied from the triangular pattern illustrated in FIG. 5. For example, the bars 202 could be linearly arrayed in a vertical column, a horizontal row, or a diagonal row. Plural rows or columns of bars 202 may be provided. Where plural rows or columns are used, rows and columns may be staggered or offset from one another (options of arrangements of bars 202 are not shown). The bars 202 may be of different lengths, diameters, and groove dimensions and spacing.

The plurality of bars 202 of the storage and display rack 200 accommodates a correspondingly greater number of necklaces 10 (FIG. 1) than could be provided by storage and display rack 100 having only one bar 102.

Figure 6:
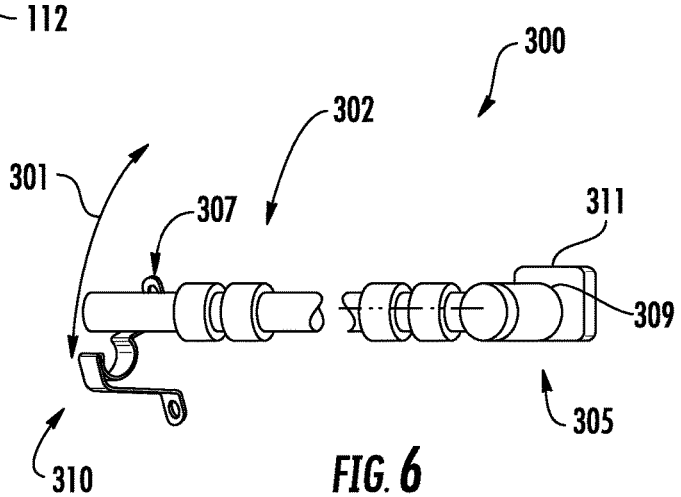
FIG. 6 is a perspective view of a storage and display rack according to at least one further aspect of the disclosure.

Referring to FIG. 6, a storage and display rack 300 includes the bar 302 adapted to pivot (as indicated by arrow 301). The bar 302 may generally have the characteristics of the bar 102 of FIGS. 1-4, with the exception that at the right end 303, as depicted in FIG. 6, a pivot mount 305 is provided. Also, the holder 310 has the characteristics of the holder 110 of FIGS. 1-4.

The storage and display rack 300 for necklaces comprises a pivot support 305 including an engagement element engaging the proximal end of the bar 302 and enabling the bar 302 to pivot thereabout. The holder 310 is at a distal end 307 of the bar 310. The pivot support 305 may include an axle 309 and a wall mounting plate 311 supporting the axle 309. The pivot support 305 enables the bar 302 to be lifted or rotated out of its former position received in the holder 310, rotation indicated by arrow 301. This enables one or more necklaces 10 (FIG. 1) to be retrieved from the bar 302. The bar 302 may then be returned to its prior position received within the holder 310.

The bars 102, 202, 302 may be made from wood, plastics, metals, and of other materials, and in combinations thereof. Each one of the first and second series of circumferential grooves 106, 108 (and corresponding circumferential grooves of bars 202 and 302) may be formed using a lathe (not shown). Of course, other materials and fabrication techniques may be used for the bars 102, 202, 302, such as injection molding from a synthetic plastic material. The bars 102, 202, 302 may be coated (e.g., painted or lined with a rubber-like material for friction enhancement), anodized, or otherwise have a surface treatment, for ornamentation or to alter friction characteristics.

The bars 102, 202, and 302, the holders 110, 310, and the wall mounting plate 204 may be provided in a variety of structures and shapes.

Different examples of the apparatuses disclosed herein include a variety of components, features, and functionalities. It should be understood that the various examples of the apparatuses disclosed herein may include any of the components, features, and functionalities of any of the other examples of the apparatuses disclosed herein in any feasible combination. All such possibilities are intended to be within the spirit and scope of the present disclosure.

Many modifications of examples set forth herein will come to mind to one skilled in the art to which the present disclosure pertains, the one skilled in the art having the benefit of the teachings presented in the foregoing descriptions and the associated drawings.

Therefore, it is to be understood that the present disclosure is not to be limited to the specific examples presented and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims.

What is claimed is:

1. A storage and display rack for necklaces, comprising:

a bar comprising a cylindrical central section having a diameter, a first series of circumferential grooves located in a fixed position on one side of the cylindrical central section, and a second series of circumferential grooves located in a fixed position on an opposed side of the cylindrical central section wherein each of the grooves is dimensioned and configured to support at least one necklace; and a holder comprising a mounting base comprising a flat base surface configured to be mounted to a supporting surface, and a grip configured to partially encircle the bar, the grip connected in relation to the flat base surface and comprising an elastic member having a circular inner wall having an extent between one hundred eighty-one and two hundred seventy degrees of a circle defined by the circular inner wall, the circular inner wall defining an opening to an interior of the circular inner wall having an extent between ninety and one hundred eighty degrees of a circle defined by the circular inner wall, the circular inner wall having an inner surface slightly smaller in diameter than the diameter of the cylindrical central section of the bar, and the circular inner wall defining an axis located centrally within a space bounded by the inner surface, wherein the axis is parallel to the inner surface and also lies in a plane that is parallel to a point tangential to the flat base surface, whereby the grip can be elastically spread open to receive and release the bar, and elastically encloses the bar at least partially and retains the bar after insertion of the bar in the grip.

2. The storage and display rack of claim 1, wherein the diameter of the cylindrical central section is equal to the diameter of the bar between any two ones of the first and second series of circumferential grooves.

3. The storage and display rack of claim 2, wherein each one of the first and second series of circumferential grooves is cut into the bar.

4. The storage and display rack of claim 2, wherein the holder is made from metal.

5. The storage and display rack of claim 1, further comprising a fastener coupling the bar to the holder.

6. The storage and display rack of claim 1, wherein the holder comprises a curtain rod holder.

7. A storage and display rack for necklaces, further comprising:

a bar comprising a cylindrical central section having a diameter;

a plurality of O-rings on the bar defining a first series of circumferential grooves on one side of the cylindrical central section and a second series of circumferential grooves on an opposed side of the cylindrical central section, wherein the O-rings are mechanical gaskets in the shape of a torus and formed from elastomer, wherein each of the grooves is dimensioned and configured to support at least one necklace; and a holder comprising:

a mounting base comprising a flat base surface configured to be mounted to a supporting surface, and a grip configured to partially encircle the bar, the grip connected in relation to the flat base surface and comprising an elastic member having a circular inner wall having an extent between one hundred eighty-one and two hundred seventy degrees of a circle defined by the circular inner wall, the circular inner wall defining an opening to an interior of the circular inner wall having an extent between ninety and one hundred eighty degrees of a circle defined by the circular inner wall, the circular inner wall having an inner surface slightly smaller in diameter than the diameter of the cylindrical central section of the bar, and the circular inner wall defining an axis located centrally within a space bounded by the inner surface, wherein the axis is parallel to the inner surface and also lies in a plane that is parallel to a point tangential to the flat base surface, whereby the grip can be elastically spread open to receive and release the bar, and elastically encloses the bar at least partially and retains the bar after insertion of the bar in the grip.

8. A storage and display rack for necklaces, comprising:

a bar comprising a cylindrical central section having a diameter a proximal end, a distal end, and a series of circumferential grooves between the proximal end and the distal end wherein each of the grooves is dimensioned and configured to support at least one necklace;

a pivot support at the proximal end of the bar, the pivot support including an engagement element engaging the proximal end of the bar and enabling the bar to pivot thereabout; and a holder at the distal end of the bar, the holder comprising a mounting base comprising a flat base surface configured to be mounted to a supporting surface, and a grip configured to partially encircle the bar, the grip connected in relation to the flat base surface and comprising an elastic member having a circular inner wall having an extent between one hundred eighty-one and two hundred seventy degrees of a circle defined by the circular inner wall, the circular inner wall defining an opening to the interior of the circular inner wall having an extent between ninety and one hundred eighty degrees of a circle defined by the circular inner wall, the circular inner wall having an inner surface slightly smaller in diameter than the diameter of the cylindrical central section of the bar, and the circular inner wall defining an axis located centrally within a space bounded by the inner surface, wherein the axis is parallel to the inner surface and also lies in a plane that is parallel to a point tangential to the flat base surface, whereby the grip can be elastically spread open to receive and release the bar, and elastically encloses the bar at least partially and retains the bar after insertion of the bar in the grip.

9. The storage and display rack of claim 8, wherein each one of the first and second series of circumferential grooves is cut into the bar.

10. The storage and display rack of claim 8, wherein the holder is made from metal.

11. The storage and display rack of claim 8, further comprising a plurality of O-rings on the bar, wherein each one of the circumferential grooves is defined between two adjacent ones of the plurality of O-rings.

12. A storage and display rack for necklaces, comprising:

a bar comprising a cylindrical central section having a diameter, a first series of circumferential grooves disposed on one side of the cylindrical central section and a second series of circumferential grooves disposed on an opposed side of the cylindrical central section, wherein each one of the grooves is located in a fixed position, wherein each of the grooves is dimensioned and configured to support at least one necklace; and a holder comprising a mounting base comprising a flat base surface configured to be mounted to a supporting surface, and a grip at least partially encircling the cylindrical central section of the bar, the grip being supported in relation to the mounting base and comprising an elastic member comprised of a wall that is partially circular so as to define an opening to an interior area defined at least in part by the wall, the opening being slightly smaller than the diameter of the cylindrical central section so as to permit the cylindrical central section of the bar to forcibly pass through the opening so as to capture the cylindrical central section of the bar in the interior area defined by the wall, wherein the first and second series of circumferential grooves are disposed on opposing sides of the holder so as to permit necklaces to be supported on opposing sides of the holder to permit access to necklaces from the opposing sides of the holder.

* * * * *